US009368898B2

(12) United States Patent
Xu et al.

(10) Patent No.: US 9,368,898 B2
(45) Date of Patent: Jun. 14, 2016

(54) CONDUCTIVE CONNECTING TERMINALS

(71) Applicant: Tyco Electronics (Shanghai) Co., Ltd., Shanghai (CN)

(72) Inventors: Haley Xu, Shanghai (CN); Wei Yuan, Shanghai (CN)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 95 days.

(21) Appl. No.: 13/951,607

(22) Filed: Jul. 26, 2013

(65) Prior Publication Data

US 2014/0030901 A1 Jan. 30, 2014

(30) Foreign Application Priority Data

Jul. 27, 2012 (CN) ..... 2012 2 03700933 U

(51) Int. Cl.

| | |
|---|---|
| ***H01R 13/52*** | (2006.01) |
| ***H01R 13/516*** | (2006.01) |
| ***H01R 13/05*** | (2006.01) |
| *H01R 13/03* | (2006.01) |
| *H01R 43/16* | (2006.01) |
| *H01R 43/24* | (2006.01) |

(52) U.S. Cl.

CPC ..... *H01R 13/516* (2013.01); *H01R 13/055* (2013.01); *H01R 13/521* (2013.01); *H01R 13/03* (2013.01); *H01R 43/16* (2013.01); *H01R 43/24* (2013.01)

(58) Field of Classification Search

CPC .. H01R 13/516; H01R 13/055; H01R 13/521; H01R 13/03

USPC ..... 439/271, 523, 587

See application file for complete search history.

(56) References Cited

U.S. PATENT DOCUMENTS

| | | | | |
|---|---|---|---|---|
| 5,118,313 | A * | 6/1992 | Delalle | 439/730 |
| 7,690,954 | B2 * | 4/2010 | Watanabe et al. | 439/730 |
| 8,360,803 | B2 * | 1/2013 | Sakai | 439/523 |
| 8,927,863 | B2 * | 1/2015 | Tanikawa et al. | 174/74 R |
| 2001/0003687 | A1 * | 6/2001 | Kondo | 439/604 |

* cited by examiner

*Primary Examiner* — Khiem Nguyen

(74) *Attorney, Agent, or Firm* — Barley Synder

(57) ABSTRACT

A conductive connecting terminal has a main body which includes a front section, a rear section and an intermediate section between the front section and the rear section. The conductive connecting terminal also has a sealing member surrounding an outer surface of the intermediate section and forming a transition connecting surface with the outer surface of the intermediate section. The sealing member is inseparably fixed on the intermediate section. The embodiments further provide an array of conductive connecting terminals formed by stamping and having a plurality of conductive connecting terminals arranged in parallel and connected at their respective rear ends through a carrier.

21 Claims, 3 Drawing Sheets

CONDUCTIVE CONNECTING TERMINALS

CROSS-REFERENCE TO RELATED APPLICATION

This application claims the benefit of Chinese Patent Application No. 201220370093.3 filed on Jul. 27, 2012 in China, the whole disclosure of which is incorporated herein by reference.

FIELD OF THE INVENTION

The present invention relates to a conductive connecting terminal and an array of conductive connecting terminals formed by stamping.

BACKGROUND

Conductive connecting terminals are extensively applied on various occasions and perform a basic function of transmitting an electronic signal/current. There are other requirements for conductive connecting terminals on some special application occasions, for example, sealing requirement. For example, an engine or gearbox of a motor vehicle uses a conductive connecting terminal passing through a cylinder body. This is a very severe application environment. A high temperature above 150° C. frequently reached in the cylinder, splash of engine oil and vibration caused by the engine itself and a road surface imposes very high requirements for the sealing performance of the conductive connecting terminal. Conventionally, both ends of the conductive connecting terminal are connected by a lead wire wrapped by an insulating skin. Although an outer circumference of the insulating skin may be sealed with a sealing member, since the lead wire employs multiple strands of copper filaments and gaps exist between copper filaments, leakage of oil probably occurs in the lead wire through capillary phenomenon.

Attempts have been made to use a connecting terminal 1 shown in FIG. 1 to solve the above problem. The connecting terminal 1 is formed from an alloy material by the machining of a turning machine, with one end 10 being formed in a barrel shape to connect the lead wire, the other end 20 mating with a female member, and an intermediate section 30 formed with a radially-raised protrusion 35 to form sealing. However, it is found that this connecting terminal at least has the following drawbacks:

First, in order to form the sealing protrusion 35 at the intermediate section, the conductive connecting terminal 1 must be formed by the machining of a turning machine and formed for a single time, which causes the manufacture cost of the connecting terminal 1 is high.

Secondly, only a tip 20 of the connecting terminal 1 mating with the female member needs to be applied a plated layer and the remaining sections needn't be applied a plated layer. However, it is found in actual application that the machined member has to be applied a plated layer on an entire surface, i.e., the whole of the connecting terminal is placed in an electroplating liquid and it is very difficult to perform selective plating, which makes the plating cost unnecessarily increased. A very high cost of the plated layer further makes the manufacture cost of the connecting terminal even higher. This drawback is particularly striking when a large number of connecting terminals need to be applied a plated layer.

Moreover, one end 10 of the connecting lead wire of the connecting terminal 1 can only match wires with limited wire diameters and cannot match wires with various wire diameters. This requires connecting terminals of different specifications upon connection with lead wires with different wire diameters.

Therefore, it is desirable to provide a new conductive connecting terminal to overcome the above-mentioned various drawbacks and shortcomings of conventional conductive connecting terminals.

SUMMARY

In view of the technical problems mentioned above, the embodiments described herein provide a conductive connecting terminal which is simple in structure, easy to manufacture and lower in manufacture cost.

The embodiments described herein also provide a conductive connecting terminal which can facilitate selective plating, particularly simultaneous selective plating of a large number of conductive connecting terminals, and can effectively reduce the manufacture cost.

The embodiments described herein further provide a conductive connecting terminal which is adapted to be used matching lead wires with various wire diameters.

According to one embodiment, the conductive connecting terminal can comprise a main body having a front section, a rear section and an intermediate section between the front section and the rear section. The conductive connecting terminal also comprises a sealing member surrounding an outer surface of the intermediate section and forming a transition connecting surface with the outer surface of the intermediate section. The sealing member is inseparably fixed on the intermediate section.

Alternatively, in the conductive connecting terminal, the intermediate section is provided with a barb structure or an outwardly-projecting structure, the barb structure engages with the sealing member to fix the sealing member on the intermediate section.

Alternatively, in the conductive connecting terminal, the sealing member surrounds the intermediate section to form at least one annular sealing surface.

Alternatively, in the conductive connecting terminal, the sealing member is an implanted injection molded member.

Alternatively, in the conductive connecting terminal, the sealing member is in a shape of a bottle gourd.

Alternatively, in the conductive connecting terminal, the main body of the conductive connecting terminal is a sheet metal member formed by stamping.

Alternatively, the conductive connecting terminal further comprises a plated layer which covers part of a surface of the front section, and the remaining part of the front section is not covered with the plated layer.

Alternatively, in the conductive connecting terminal, the rear section comprises a pair of wings which are press fitted with a conductive portion of the lead wire.

Alternatively, in the conductive connecting terminal, the rear section also comprises another pair of wings for press fitting an insulating envelope of the lead wire behind the pair of wings.

The embodiments described herein further provide an array of conductive connecting terminals formed by stamping. The array of conductive connecting terminals can comprise a plurality of conductive connecting terminals arranged in parallel, and a carrier for simultaneously connecting rear ends of the plurality of conductive connecting terminals.

Alternatively, in the array of conductive connecting terminals, the conductive carrier and the main body of the conductive connecting terminal are a unitary structure.

Alternatively, in the array of conductive connecting terminals, the conductive carrier is a sheet metal member formed by stamping.

One of the advantageous effects of the embodiments described herein is that the conductive connecting terminal is simple in structure, easy to manufacture and lower in manufacture cost.

Another advantageous effect of the embodiments described herein is that the conductive connecting terminal facilitates selective plating, particularly facilitates simultaneous selective plating of a plurality of conductive connecting terminals, and further reduces the manufacture cost.

Another advantageous effect of the embodiments described herein is that the conductive connecting terminal may be used matching lead wires with different wire diameters.

These and other objects, features and advantages of the embodiments will become more fully apparent after reading the following detailed description and the accompanying drawings. Various specific embodiments are described in the following with reference to the drawings forming part of the specification. It should be appreciated that although terms indicative of directions such as "front", "rear", "up" and "down" are used in the specification to describe structural portions and elements of various examples of the embodiments, use of these terms is only for purpose of easy description and determined based on orientations of examples shown in the accompanying figures. Since the embodiments disclosed herein can be arranged according to different directions, these terms indicative directions are used only for illustration purpose and should not be considered as limiting the invention. In possible cases, the same or like reference numbers used in the different embodiments designate the same members.

BRIEF DESCRIPTION OF THE DRAWINGS

The following description is set forth in connection with the attached drawing figures, which are not necessarily to scale, emphasis instead generally being placed upon illustrating the principles of the invention. In the drawing figures.

DETAILED DESCRIPTION OF EMBODIMENTS

Figure 1:
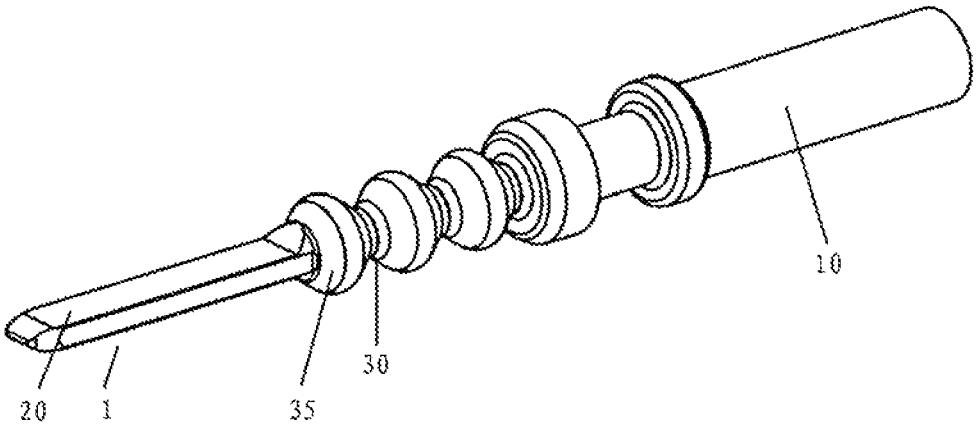
FIG. 1 Prior Art
FIG. 1 is a perspective view of a conventional conductive connecting terminal.

Embodiments will be described hereinafter in detail with reference to the attached drawings, wherein the like reference numerals refer to the like elements throughout the specification. These embodiments should not be construed as being limited to the embodiment set forth herein, rather for illustrative purpose.

Figure 2:
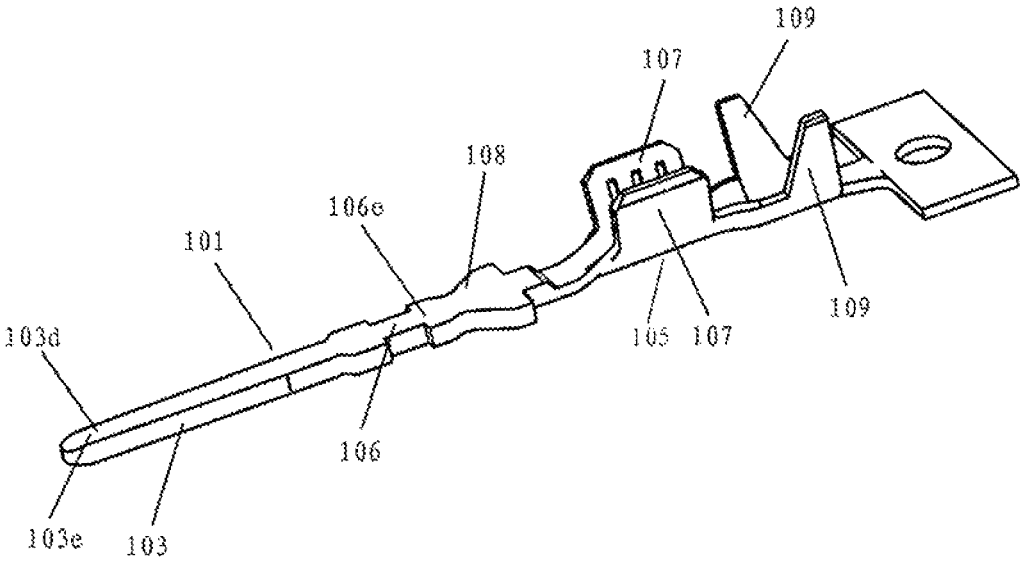
FIG. 2 is a perspective view of a main body of a conductive connecting terminal according to the present invention.

FIG. 2 shows a structure of a main body 101 (without a sealing member) of a conductive connecting terminal 10 according to the present invention. The main body 101 comprises a front section 103, a rear section 105 and an intermediate section 106 between the front section 103 and the rear section 105, wherein the intermediate section 106 has an outer surface 106*e*. The main body 101 is preferably a sheet metal member formed by stamping. As compared with the conductive connecting terminal 1 formed by machining of a turning machine shown in FIG. 1, the main body of the conductive connecting terminal according to the present invention is more convenient in processing and manufacture. Particularly, continuous stamping may be performed so that the manufacture cost of a single conductive connecting terminal may be substantially reduced.

Figure 3:
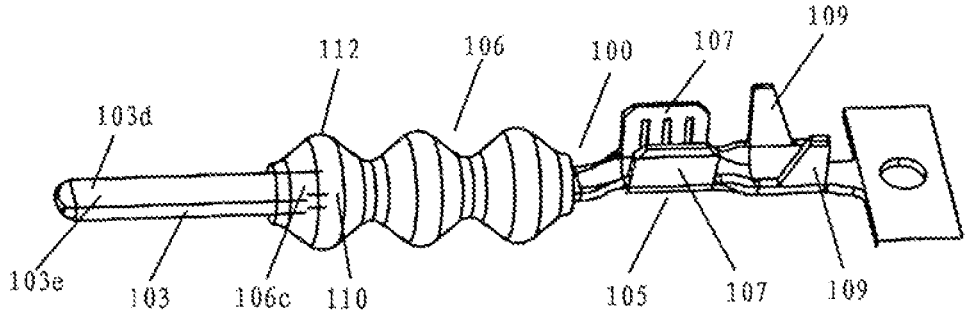
FIG. 3 is a perspective view of a conductive connecting terminal according to the present invention.
Figure 4:
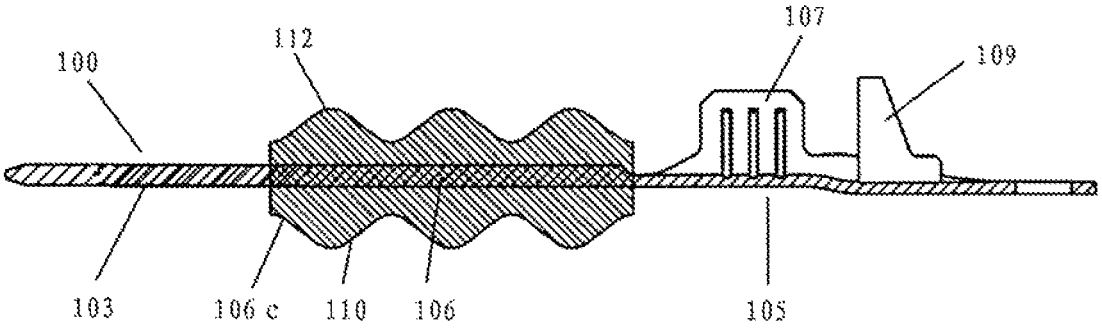
FIG. 4 is a cross-sectional view of the conductive connecting terminal of FIG. 3 taken in an axial direction.

FIG. 3 shows a conductive connecting terminal 100 according to the present invention. The main body 101 is mounted with a sealing member 110. The sealing member 110 surrounds the outer surface 106*e* of the intermediate section 106 and forms a transition surface 106*c* with the outer surface 106*e* of the intermediate section. The sealing member 110 is inseparably fixed on the intermediate section 106. In FIG. 1, a sealing protrusion and a main body of the conductive connecting terminal are integrally formed by the machining of a turning machine. Different from FIG. 1, the sealing member 110 and main body 101 of the conductive connecting terminal according to the present invention are two independent members and not integrally formed. Alternatively, the sealing member 110 is an implanted injection molded member, which can avoid complicated machining of the turning machine and reduce the processing cost of the conductive connecting terminal. FIG. 4 is a cross-sectional view of the conductive connecting terminal of FIG. 3 taken in an axial direction and more clearly shows internal construction of the conductive connecting terminal 100.

The sealing member 110 protrudes radially outwardly along the main body 101. Alternatively, the sealing member 110 surrounds the intermediate section 106 to form at least one annular sealing surface 112. It may be appreciated that the number of sealing members may be set according to a length of the intermediate section and sealing requirements. Alternatively, the sealing member 110 is in a shape of a bottle gourd as shown in FIG. 3.

Now turning back to FIG. 2, description will be made in connection with the structure of the main body 101. The intermediate section 106 is provided with a barb structure or an outwardly-projecting structure 108. The barb structure 108 engages with the sealing member 110 to fix the sealing member 110 on the intermediate section 106. The barb structure or other outwardly-projecting structures further facilitates inseparable fixation of the sealing member on the intermediate section 106.

The rear section 105 of the conductive connecting terminal 100 is used to connect to a lead wire. Alternatively, it comprises a pair of wings 107 which are press fitted with a conductive portion of the lead wire. As compared with a barrel-shaped lead wire connecting structure of a rear section of the conductive connecting terminal formed by machining of the turning machine shown in FIG. 1, the wing-shaped lead wire connecting structure is not only integrally formed with the main body 101 by stamping and manufactured conveniently, but also may be press-fitted with lead wires with different wire diameters. Alternatively, another pair of wings 109 are provided behind the pair of wings 107. The second pair of wings 109 are used to press fit an insulating envelope of the lead wire and thereby function to firmly connect the lead wire to the main body of the conductive connecting terminal.

The conductive connecting terminal 101 further comprises a plated layer 103*d* which covers part of a surface of the front section 103. The remaining part of the front section 103 is not covered with the plated layer 103*d*. For example, the plated layer 103*d* only covers a tip section 103*e* of the front section 103 which mates with a female member. As compared with the conductive connecting terminal 1 shown in FIG. 1, the conductive connecting terminal 100 avoids unnecessary plated layer, and thereby substantially reduces the manufacturing cost of the terminal.

Figure 5:
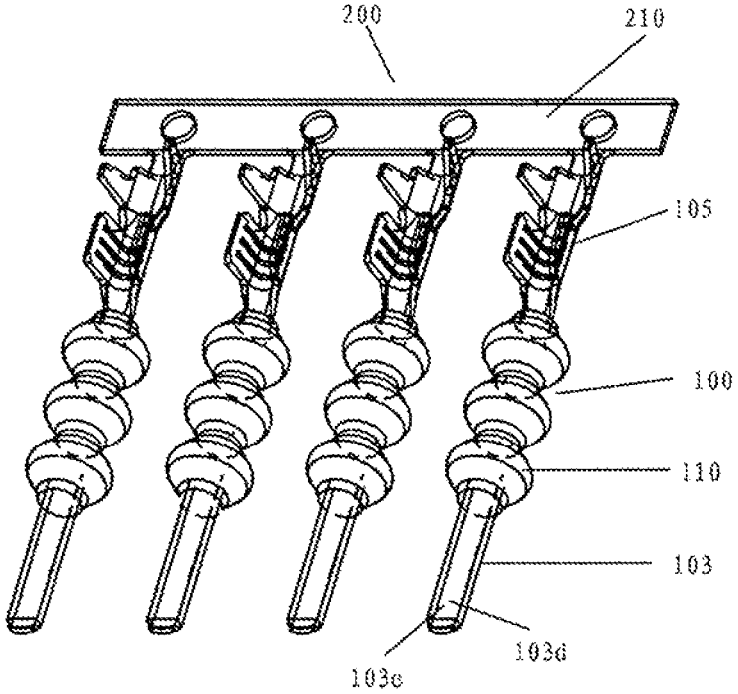
FIG. 5 is an array of conductive connecting terminals formed by stamping according to the present invention.

FIG. 5 is an array 200 of conductive connecting terminals formed by stamping according to the present invention. The array 200 comprises a plurality of conductive connecting terminals 100 arranged in parallel. The rear ends 105 of the plurality of parallel conductive connecting terminals 100 are simultaneously connected to a carrier 210. The carrier 210 and the main body 101 of the conductive connecting terminal are a unitary structure and they both are sheet metal members formed by stamping. As such, the carrier 210 and main bodies 101 of the plurality of conductive connecting terminals can be formed by continuous stamping. The sealing member 110 is engaged on each of the main bodies. After the female member-mating tip sections 103*e* of the front sections 103 of the main bodies of the conductive connecting terminals are applied the plated layer 103*d*, the array of the conductive connecting terminals are divided to form individual conductive connecting terminals 100.

Based on the array of conductive connecting terminals formed by stamping and the structure of the conductive connecting terminals according to the present invention, the conductive connecting terminal according to the present invention can very conveniently achieve application of a plated layer only on a selected length of the tip section of the front section of the main body of the connecting terminal. Illustration will be presented by referring to FIG. 6.

Figure 6:
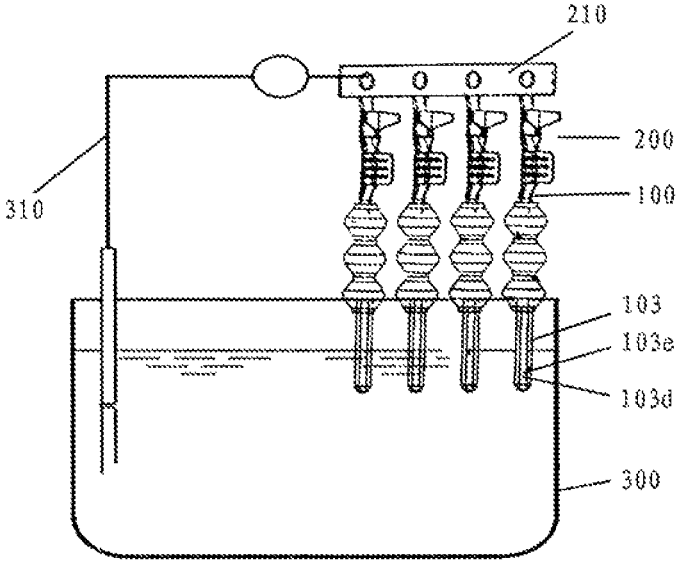
FIG. 6 is a schematic view illustrating the array of conductive connecting terminals of FIG. 5 being subjected to selective plating.

FIG. 6 is a schematic view illustrating that all conductive connecting terminals 100 in the array 200 of conductive connecting terminals of FIG. 5 are simultaneously operated through selective plating. The array of the conductive connecting terminals 200 are hung above an electroplating liquid container 300 via the carrier 200, the tip sections 103*e* of the front sections of the plurality of parallel conductive connecting terminals 100 are immersed in the electroplating liquid, the carrier 210 is connected with the electroplating liquid in the electroplating liquid container 300 via a conductor 310 so that the tip sections immersed in the electroplating liquid are applied a plated layer. The remaining section of the main body of the conductive connecting terminal not immersed in the electroplating liquid is not applied a plated layer. The length on which the plated layer is applied is conveniently selected completely according to actual needs. The present invention substantially reduces the electroplating cost as compared with the case in which the whole terminal is immersed in the electroplating liquid to apply a plated layer on the whole terminal.

Furthermore, through the above descriptions, those skilled in the art should appreciate that selective plating for the plurality of conductive connecting terminals 100 can be simultaneously achieved via the carrier 210 without need to provide other complicated devices, so that the manufacture cost of the conductive connecting terminals 100 will not be increased whilst convenient selective plating is achieved. On the contrary, the conductive connecting terminal 1 formed by the machining of the turning machine shown in FIG. 1 is unlikely to be subjected to the selective plating conveniently in the above way, particularly simultaneous selective plating for a plurality of conductive connecting terminals.

Although the present invention is described with reference to specific embodiments shown in the figures, it should be appreciated that without departing from the spirit and scope taught by the present invention, the conductive connecting terminal and the array of conductive connecting terminals according to the present invention may have many variations. Parts in different specific embodiments of the present invention can be interchangeable or re-combinable without departing from the spirit and scope taught by the present invention, whereby the obtained conductive connecting terminal and array of conductive connecting terminals also fall within the scope of the present invention. Those having ordinary skill in the art should appreciate that parameters such as dimensions, shapes or types of elements or materials of the disclosed embodiments may be changed in different manners, all falling within the spirit and scope of the present invention and the appended claims.

What is claimed is:

1. A conductive connecting terminal comprising:

a main body which includes a front section, a rear section adapted to connect with a lead wire, and an intermediate section between the front section and the rear section; and a sealing member surrounding an outer surface of the intermediate section and forming a transition connecting surface with the outer surface of the intermediate section, wherein the sealing member is inseparably fixed on the intermediate section before the rear section of the main body connects with a lead wire.

2. The conductive connecting terminal according to claim 1, wherein the intermediate section is provided with a barb structure or an outwardly-projecting structure, which joins with the sealing member to fix the sealing member on the intermediate section.

3. The conductive connecting terminal according to claim 1, wherein the sealing member surrounds the intermediate section to form at least one annular sealing surface.

4. The conductive connecting terminal according to claim 1, wherein the sealing member is an implanted injection molded member.

5. The conductive connecting terminal according to claim 1, wherein the main body of the conductive connecting terminal is a sheet metal member formed by stamping.

6. The conductive connecting terminal according to claim 1 further comprising a plated layer which covers part of a surface of the front section: wherein the remaining part of the front section is not covered with the plated layer.

7. The conductive connecting terminal according to claim 1, wherein the rear section comprises a pair of wings for press fitting with a conductive portion of a lead wire and another pair of wings for press fitting with an insulating envelope of the lead wire.

8. An array of conductive connecting terminals formed by stamping, the array of conductive connecting terminals comprising:

a plurality of conductive connecting terminals arranged in parallel, each conductive connecting terminal comprising:

a main body which includes a front section, a rear section adapted to connect with a lead wire, and an intermediate section between the front section and the rear section; and a sealing member surrounding an outer surface of the intermediate section and forming a transition connecting surface with the outer surface of the intermediate section, wherein the sealing member is inseparably fixed on the intermediate section before the rear section of the main body connects with a lead wire; and a carrier for simultaneously connecting rear ends of the plurality of conductive connecting terminals.

9. The array of conductive connecting terminals according to claim 8, wherein the intermediate section is provided with a barb structure or an outwardly-projecting structure, which joins with the sealing member to fix the sealing member on the intermediate section.

10. The array of conductive connecting terminals according to claim 8, wherein the sealing member surrounds the intermediate section to form at least one annular sealing surface.

11. The array of conductive connecting terminals according to claim 8, wherein the sealing member is an implanted injection molded member.

12. The array of conductive connecting terminals according to claim 8, wherein the main body of the conductive connecting terminal is a sheet metal member formed by stamping.

13. The array of conductive connecting terminals according to claim 8 further comprising a plated layer which covers part of a surface of the front section wherein the remaining part of the front section is not covered with the plated layer.

14. The array of conductive connecting terminals according to claim 8, wherein the rear section comprises a pair of wings for press fitting with a conductive portion of a lead wire and another pair of wings for press fitting with an insulating envelope of the lead wire.

15. The array of conductive connecting terminals according to claim 8, wherein the conductive carrier and the main body of the conductive connecting terminal are a unitary structure.

16. The array of conductive connecting terminals according to claim 15, wherein the conductive carrier is a sheet metal member formed by stamping.

17. A conductive connecting terminal, comprising:

a main body which includes a front section, a rear section adapted to connect with a lead wire, and an intermediate section between the front section and the rear section; and a sealing member surrounding an outer surface of the intermediate section and forming a transition connecting surface with the outer surface of the intermediate section, wherein the sealing member is inseparably fixed on the intermediate section and has an outer surface forming at least one annular projection protruding radially outwardly from the outer surface of the sealing member.

18. The conductive connecting terminal according to claim 17, wherein the intermediate section is provided with a barb structure or an outwardly-projecting structure, which joins with the sealing member to fix the sealing member on the intermediate section.

19. The conductive connecting terminal according to claim 17, wherein the main body of the conductive connecting terminal is a sheet metal member formed by stamping.

20. The conductive connecting terminal according to claim 17 further comprising a plated layer which covers part of a surface of the front section:

wherein the remaining part of the front section is not covered with the plated layer.

21. A conductive connecting terminal comprising:

a main body which includes a front section matable with a mating member, a rear section having at least one pair of wings, and an intermediate section between the front section and the rear section; and a sealing member disposed between the front section and the at least one pair of wings, the sealing member surrounding an outer surface of the intermediate section and forming a transition connecting surface with the outer surface of the intermediate section, wherein the sealing member is inseparably fixed on the intermediate section.

* * * * *